US005313777A

United States Patent [19]

Rottmayr et al.

[11] Patent Number: 5,313,777

[45] Date of Patent: May 24, 1994

[54] SPINNING PROCESS AND DEVICE FOR THE PRODUCTION OF A YARN

[75] Inventors: Johann Rottmayr, Reutlingen; Werner Billner, Ingolstadt, both of Fed. Rep. of Germany

[73] Assignee: Schubert & Salzer Maschinenfabrik AG, Ingolstadt, Fed. Rep. of Germany

[21] Appl. No.: 19,771

[22] Filed: Feb. 19, 1993

Related U.S. Application Data

[62] Division of Ser. No. 666,043, Mar. 7, 1991, Pat. No. 5,241,813.

[30] Foreign Application Priority Data

Mar. 9, 1990 [DE] Fed. Rep. of Germany ..... 4007607

[51] Int. Cl.[5] ..... D01H 4/04

[52] U.S. Cl. ..... 57/400

[58] Field of Search ..... 57/400, 401, 403, 404, 57/408, 411, 413, 415, 417

[56] References Cited

U.S. PATENT DOCUMENTS 3,898,788 8/1975 Fehrer .
4,130,983 12/1978 Dammann et al. .
4,321,789 3/1982 Dammann et al. .
4,557,105 12/1985 Brockmanns et al. .
4,573,312 3/1986 Brockmanns et al. .
4,574,572 3/1986 Fehrer .
4,628,679 12/1986 Stalder et al. .
4,676,062 6/1987 Brockmanns et al. .
4,677,815 7/1987 Stahlecker .
4,696,155 9/1987 Stalder et al. .
4,697,409 10/1987 Handschuch et al. .
4,704,853 11/1987 Lawrence .
4,704,859 11/1987 Nerli et al. .
4,718,227 1/1988 Handschuch .
4,731,986 3/1988 Billner .

FOREIGN PATENT DOCUMENTS 382644 3/1987 Austria .
2618865A1 11/1977 Fed. Rep. of Germany .
3441495C2 9/1988 Fed. Rep. of Germany .
264944A1 2/1989 Fed. Rep. of Germany .
1490473 6/1967 France .
1285003 8/1972 United Kingdom .
2178451 2/1987 United Kingdom .

*Primary Examiner*—Joseph J. Hail, III
*Attorney, Agent, or Firm*—Dority & Manning

[57] ABSTRACT

The instant invention relates to a spinning process and to a device for the production of a yarn. In the spinning process the fibers are conveyed to a perforated collection surface which is subjected to suction in one zone. They are brought together into a fiber accumulation on the collection surface. The fiber accumulation is drawn off from the collection surface and twisted into a yarn of predetermined twist in a twisting element which follows the collection surface in the direction of yarn draw-off. The fibers are accumulated at a suction edge constituting a collection line and are pre-twisted at said collection line.

17 Claims, 8 Drawing Sheets

SPINNING PROCESS AND DEVICE FOR THE PRODUCTION OF A YARN

This is a division of application Ser. No. 07/666,043, filed Mar. 7, 1991 now U.S. Pat. No. 5,241,813.

BACKGROUND OF THE INVENTION

The instant invention relates to a spinning process and to a device for the production of yarn.

It is known from DE 34 41 495 that the fiber material for yarn is deposited in form of individual fibers on a collection surface moving in direction of yarn draw-off for the production of a yarn of good quality at high production speed. This fiber material is then withdrawn continuously in form of a yarn while being imparted a twist. The already finished yarn is not overfed with fibers but the latter are conveyed to the yarn end. An oriented deposit of the fibers on the collection surface is achieved by feeding the individual fibers in direction of the movement of the collection surface. The fiber material is bundled and/or doubled into a fiber sliver with the fiber mass sufficient for the desired yarn on the collection surface. The surface speed of the collection surface is approximately equal to the yarn draw-off speed so that the full mass of fibers required for the completed yarn is already collected on the collection surface, is conveyed in closed fiber formation in direction of the twisting element and is twisted into a yarn. This does not however always lead to the desired yarn of good quality. A draft with the ensuing further parallel positioning of the fibers is effected in a preferred embodiment by providing for a surface speed of the collection surface that is lower than the yarn draw-off speed. The fibers are thereby stretched as they are drawn off from the collection surface.

It is a disadvantage in this system that the fibers flying out of the opening roller are compressed as they impact the collection surface.

Another known art is DD 264.944 A1 which discloses fiber applicators for internal friction spinning devices for the precise feeding and stretching of the supplied and opened fibers. The fibers are stretched axially in a fiber applicator and slide from the fiber applicator on the concave internal surface of a friction bell. The rotation of the friction bell causes the fibers to be fed to an easily twisted fiber tuft which is imparted its twist by rolling against concave inner surface of the friction bell together with the sucking action of air exhaust bores. The yarn which is now collected into a completed yarn cross-section is imparted further twist between the surfaces of the downstream friction roller and the concave friction bell rotating in opposite directions. An even higher degree of twist acting counter to the back-twist torque can be achieved by means of a downstream twist-imparter.

It is a disadvantage in this device that the fiber tuft is easily twisted and thereby prevents great yarn uniformity because considerable fluctuations of the spinning tension have an unfavorable influence on the yarn quality. It is a further disadvantage that the yarn is held between the surfaces of the friction roller and of the concave friction bell rotating in opposite directions merely by the easily twisted fiber tuft. Thus a yarn twist between friction roller and friction bell that is independent of the speed of the collection surface is not possible. An additional twist-imparter is therefore installed after the friction roller and the friction bell.

OBJECTS AND SUMMARY OF THE INVENTION

It is the object of the instant invention to create a process and a device by which fibers are conveyed in an orderly fashion to a twisting element to obtain a yarn of high quality and by which the disadvantages of the state of the art are avoided.

According to the invention the fibers are collected at a suction edge forming a collection line and the fiber accumulation thus created is pre-twisted at the collection line. This has the advantage that the fibers are extraordinarily well oriented within the fiber accumulation. The pre-twist of the fiber accumulation causes the individual fibers to be stretched and to be evened out in their position relative to each other. The fiber accumulation which is constantly made up of new fibers lies in this case at the collection line during the spinning process and is pre-twisted at that location.

If the fibers are conveyed to the collection line on the collection surface at an angle of less than 45° between fiber axis and collection line, good and uniform incorporation of the fibers into the rotating fiber accumulation results. If the fibers on the collection surface are conveyed to the collection line in a position that is essentially parallel to said collection line, said fibers roll against each other without becoming incorporated helically into the fiber accumulation. The orientation of the individual fibers in that case is especially good.

In an advantageous embodiment the fiber accumulation is pre-twisted at a slower speed than the later twist imparted to it by the downstream twisting element. As a result a certain amount of stretching of the fibers in the fiber accumulation occurs, ensuring an orderly positioning of the fibers when they reach the twisting element.

The deposit of the fibers on the collection surface in the main direction in which the perforations of said collection surface are oriented causes the fibers to be conveyed to the collection line in a kind of fleece in which the fibers lie parallel to each other.

In advantageous embodiments of the invention, the fiber accumulation can be imparted thrust or traction forces at the collection line. This results in folding over or drawing the fiber accumulation.

To stabilize the fiber accumulation at the collection line, the fiber accumulation is pre-twisted in a direction opposite to the twisting direction imparted by the twisting element. The transition point produced of the direction of twist in the fiber accumulation or in the yarn being produced which thus occurs, appears generally in the area of the collection surface.

In the device according to the instant invention, the collection surface can be moved essentially at a perpendicular to a collection line accumulating the fibers and is made separately from the twisting element. In this manner a separation between the introduction of twist into the fiber accumulation and that which introduced into the yarn is produced in an advantageous manner. Significant advantages then result from the different speeds of the collection surface for the conveying of the fibers to the collection line on the one hand, and of the twisting element to impart the final twist into the yarn on the other hand. Uncoupling of collection surface and twisting element has shown to have distinct advantages in the orientation of the fibers and thereby also in the quality of the yarn and in its strength.

Sieve rollers, sieve disks or sieve bands can be used as the collection surfaces. The collection surface is thereby subjected to suction through the sieve surface. This causes the fibers to be held on the collection surface to be conveyed from the fiber intake point to the collection line. Pairs of friction rollers or air spinning nozzles can be used advantageously as the twisting elements. However, twisting tubes or other twist-imparting elements can also be used. To stabilized the fiber accumulation, the direction of movement of the collection surface is advantageously opposite to the direction of rotation of the pair of friction rollers. A lower speed of the collection surface than the speed of the friction rollers achieves advantages with respect to yarn quality. More twist is imparted to the yarn by the friction rollers than by the collection surface to the fiber accumulation. The transition point of the yarn twist with respect to fiber twist is located in the area of the collection surface in an advantageous embodiment.

The collection line on the collection surface is defined by a slit edge of the suction insert. The fibers detach themselves from the collection surface at this suction slit edge and are pre-twisted in the fiber accumulation.

Especially good incorporation of the fibers into the fiber accumulation has been achieved if the collection line includes an angle between 20° and the perpendicular to the direction of movement of the collection surface. In an advantageous embodiment the angle between the main direction of orientation of the perforation of the collection surface and the collection line is less than 45°. The fibers are then incorporated into the fiber accumulation without compression so that great strength of the yarn results. If the main direction of orientation of the perforation of the collection surface and the collection line or the slit edge are parallel to each other the fibers roll against each other along their longitudinal axis without formation of a helical twisting of the fibers. The stretched fibers are then incorporated into the rotating yarn.

BRIEF DESCRIPTION OF THE DRAWINGS

Further advantages of the invention can be derived from the following description of embodiments in which.

DESCRIPTION OF THE PREFERRED EMBODIMENTS

The following description is of preferred embodiments of the invention. It will be apparent to those skilled in the art that various modifications and variations can be made in the apparatus and process of the invention. These variations, modifications, and equivalent apparatus and process, fall within the spirit of the present invention and it is intended that such come within the scope of the appended claims and their equivalents.

Figure 1:
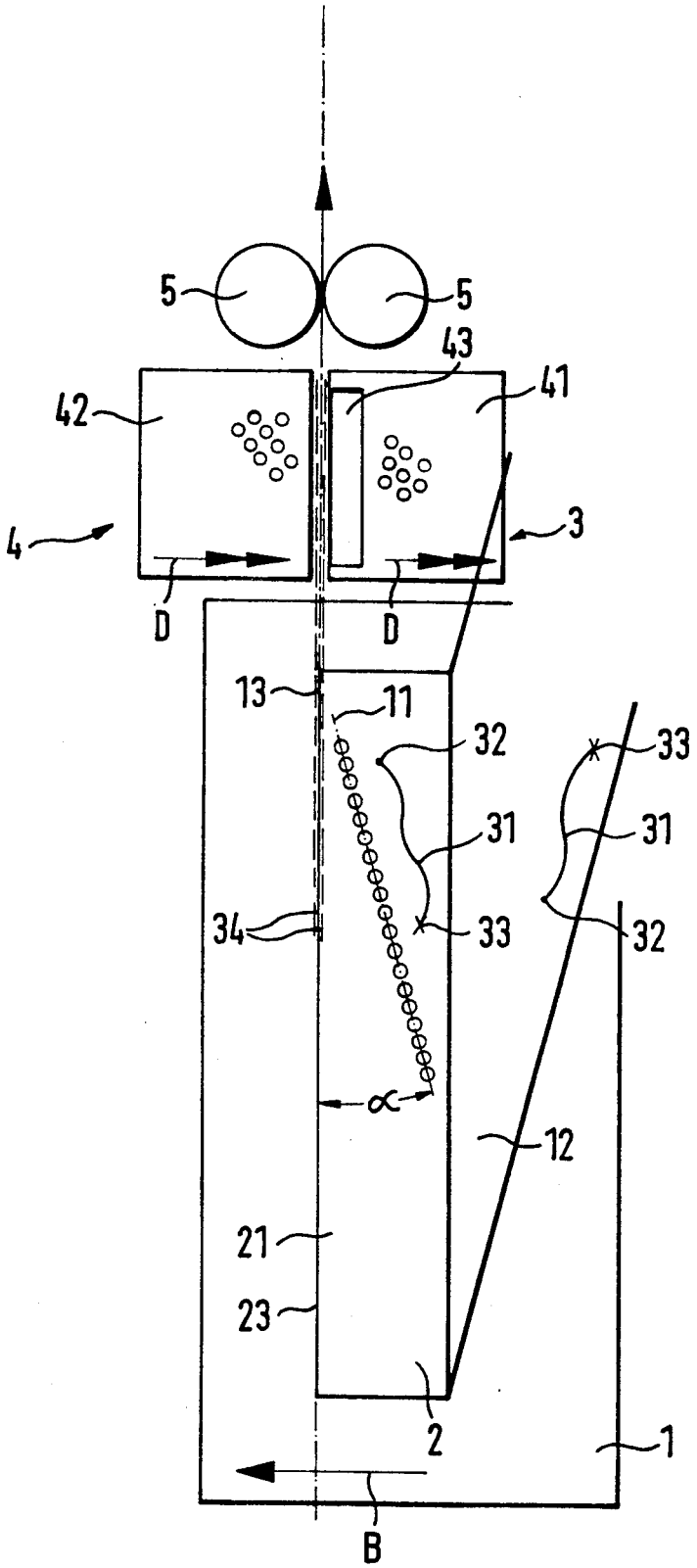
FIGS. 1 to 4 show basic sketches of the device according to the invention

Fig. 1 shows an embodiment in which the fibers 31 are fed through a fiber feeding channel 3 onto a sieve roller 1 which serves as a collection surface. The fibers 31 land with a fiber head 32 on the portion of sieve roller 1 which is subjected to suction. The suction is effected through a rectangular suction slit 21 in a suction insert 2 of the sieve roller 1. While the fiber head 32 is already laid down on the sieve roller 1 subjected to suction, the sieve roller 1 and a fiber end 33 continue to move in direction of flight. Depending on the arrangement of the suction holes 12 in a main sense of orientation 11, as well as depending on the angle between direction of fiber flight and the main sense of orientation 11, a fiber fold-over takes place. This means that the fiber 31 is deposited on the sieve roller 1 in the main sense of orientation 11 of the suction holes 12 and that the fiber head 32 is essentially placed in opposition to its original position with respect of the direction of fiber flight. The main sense of orientation 11 of the suction holes 12 results essentially from a shorter distance between individual suction holes 12 than between suction holes 12 which are not arranged in the main sense of orientation. The main sense of orientation 11 is at an angle $\alpha$ to a suction edge 23 of the rectangular suction slit 21. This angle $\alpha$ is less than 45°, preferably 20°.

The fibers 31 are deposited along the main sense of orientation 11 of the suction holes 12 on the sieve roller 1, as the suction forces acting upon the fibers 31 are strongest on this line. In any other direction the distance from one suction hole 12 to the next suction hole 12 would be greater, so that the fiber 31 would not be guided over a longer distance. The fibers 31 therefore tend to settle in the main sense of orientation 11 on the sieve roller 1 when the feeding of the fibers is carried out at an angle permitting a fold-over of fibers or which is essentially parallel to the main sense of orientation 11. It is furthermore necessary for the deposit in the main sense of orientation 11 for the sieve roller 1 to rotate at a speed, as compared to the speed of fiber flight, that makes it possible for the fibers 31 to assume the desired position. The fibers 31 are then conveyed on the suction roller in direction of a suction edge 23.

The fibers 31 accumulate at the suction edge 23 of the rectangular suction slit 21. At this location there is essentially an equilibrium between the slaving forces of the sieve roller 1 and the suction force taking effect through the suction slit 21 and the centrifugal force which tends to throw off the fibers 31. This equilibrium of forces produces a fiber circuit at the suction edge 23. The fibers 31 are slaved up to the suction edge 23, detach themselves at that point since there is no suction force after the suction edge 23, and are then fetched back by the suction of the suction insert 2. The delivery of fibers 31 at an angle $\alpha$ at the suction edge 23 or collection line 13 causes the fibers 31 to be accumulated into a fiber accumulation 34 and to be pre-twisted in such manner that they wind themselves around each other. At the same time the fibers are pre-twisted with great regularity into a kind of fiber sliver with fiber spirals and is drawn off from the sieve roller by a pair of draw-off rollers 5 after incorporation into the yarn end.

In the embodiment of FIG. 1, the collection line 13 is parallel to the axial line of the sieve roller 1. The fiber accumulation 34 is rotated in the opposite sense of the direction of movement B of the sieve roller 1, i.e. it rolls against the sieve roller 1. A slightly increased draw-off speed of the pair of draw-off rollers 5 over the speed of the feeding of fibers 31, produces a small amount of draft, causing the fibers 31 to be stretched once more in the fiber accumulation 34. The fibers 31 are incorporated at a faster speed than the speed of their arrival. Thereby the fiber spindles produced at the suction edge are twisted together, thus avoiding enveloping fibers.

A twisting element 4 is installed between the pair of draw-off rollers 5 and the sieve roller 1. In the embodiment of FIG. 1 the twisting element 4 consists of a pair of friction rollers with a friction roller 41 subjected to suction and a friction roller 42 not subjected to suction. Both friction rollers rotate in the same direction D. The direction of rotation D is opposite to the direction of movement B of the sieve roller. As a result the fiber accumulation 34 is brought into its predetermined state of yarn twist contrary to the pre-twist. The fiber accumulation 34 is held by a suction insert 43 in the spinning nip of the friction rollers 41 and 42. As required, either one friction roller subjected to suction, as in this embodiment, or two friction rollers subjected to suction can be used. By changing the direction of rotation of the fiber accumulation 34, further alignment and stretching of the fibers is achieved. Furthermore an adherence of the fiber accumulation 34 against the collection line 13 due to additional force is achieved, so that the yarn is given the required spinning tension.

The sieve roller 1 and the twisting element 4 are advantageously placed as close to each other as possible in the direction of yarn draw-off. This applies in particular to the placement of the suction inserts 2 and 43. In the design of the embodiment of the device care must therefore be taken that the non-guided path of the fiber accumulation 34 between the sieve roller 1 and the twisting element 4 be as short as possible. The suction inserts 2 and 43 are therefore advantageously placed directly next to each other.

The lengths of the suction inserts 2 and 43 are sized so that they are able to carry out their function. This means that the suction insert 2 of sieve roller 1 must be of a length permitting the fibers 31 to be deposited in the main sense of orientation 11. In the case of FIG. 1 the length of the suction insert 2 must be sized so that the fibers are able to fold over and can be subjected to suction once more after folding over. The length of the suction insert 43 must be sized so that it is sufficient for a pre-twisting of the pre-twisted fiber accumulation 34.

The position of the suction slit 43 in relation to the nip merely fine-tunes the friction action between the surfaces of the friction rollers 41 and 42 and the yarn. The suction slit 43 may therefore be placed either before or after the narrowest point of the nip. The position of the suction slit 43 produces a force with which the yarn is pulled into the nip.

The width of the suction insert 2 must be sufficiently great so that the fibers have sufficient room between the arrival point and the collection line 13 in order to adhere to the suction holes 12 in a stretched state in a main sense of orientation 11. The width of the suction insert 2 therefore depends upon the angle $\alpha$ between the main sense of orientation 11 and the suction edge 23. The greater angle $\alpha$, the wider the suction insert 2 must be made for an identical fiber length.

The width of the suction slit 43 must be sized so that the yarn is held in the nip between the friction rollers 41 and 42. In principle the goal in sizing the suction inserts must be to keep them as small as possible. In this way energy is saved in suction and economical production of the yarn is thereby ensured.

A rotational speed of the sieve roller 1 which is quite low by comparison with the friction rollers 41 and 42 has proven to be advantageous. Thanks to the low rotational speed of the sieve roller 1, the fibers 31 are able to adhere against the suction holes 12 in the main sense of orientation 11. The slow speed thus makes it possible to achieve better orientation of the fibers 31 as the centrifugal forces acting upon the rotating sieve roller 1 are lower. Thus the goal of keeping the rotational speed of the sieve roller 1 as low as possible is satisfied, and on the other hand the minimum rotational speed of the sieve roller 1 is limited through the fact that the fibers 31 must be prevented from being sucked into the suction holes 12 of the collection surface. If the fibers 31 are sucked into the suction holes 12 the fibers 31 are prevented from detaching themselves from the sieve roller 1 at the collection line 13 and the orientation is thereby disturbed once again. The size of the suction holes 12 must be sized so that sufficient suction force acts upon the fibers 31 on the one hand, while the size of suction hole 12 is sufficiently small on the other hand so that sufficient resistance is provided against the fibers 31 being sucked into the suction holes 12 so that the fibers are able to withstand being sucked in between their point of arrival and the collection line 13. Limitation of the minimal rotational speed of the sieve roller 1 is furthermore ensured through the fact that the fibers 31 do not constitute a tight fleece on the sieve roller 1 but are conveyed to the collection line 13 as much as possible without influence from each other.

In contrast to the rotational speed of the sieve roller 1, it is advantageous for the rotational speeds of the friction rollers 41 and 42 to be relatively high. High rotational speeds of the friction rollers 41 and 42 have an advantageous effect in imparting twist to the yarn.

The fiber feeding channel 3 is installed in such manner on the sieve roller 1 that the fibers 31 are fed to the circumferential surface of the sieve roller 1 essentially at a tangent. The fibers 31 are able, with such feeding, to settle practically without compression on the sieve roller 1. The fiber feeding channel 3 must furthermore be installed on the sieve roller 1 in such manner that the suction of the suction insert 2 takes effect in the fiber feeding channel 3. The negative pressure taking effect in the fiber feeding channel 3 causes the fibers 31 to be sucked in direction of the outlet of fiber feeding channel 3. To achieve maximum negative pressure which aspires the fibers 31 at the appropriate speed on the one hand and to achieve a low negative pressure on the sieve roller 1 in the area between arrival point and collection line 13 on the other hand, it is possible to provide different suction zones of the suction insert 2. Thus it is advantageous for a greater negative pressure to take effect near the arrival point than in the area of the conveying path. In the area of fiber incorporation it is furthermore advantageous if the negative pressure can be varied so that retaining forces acting upon the fibers 31 during incorporation may be adjusted optimally to stretch the fibers 31.

The inclination of the fiber feeding channel 3 and the interface of the fiber feeding channel 3 and the interface between said fiber feeding channel 3 and the outlet are designed so that the fiber deposit is spread out as widely as possible in the fiber feeding channel 3, wider than in the fiber fly. Much room is thereby created for the individual fiber 31 and therefore undisturbed fiber fold-over can take place.

The outlet of the fiber feeding channel 3 need not necessarily be parallel to the axial line. Although this simplifies the design of the fiber feeding channel 3 it is not absolutely necessary.

The principal of the instant invention is based on open-end spinning. Individual fibers 31 are conveyed to the collection line 13 where they are folded over. Fiber feeding on the sieve roller 1 is carried out via an opener roller and the fiber feeding channel 3, whereby the fibers 31 are deposited on the suction holes 12 in form of a thin fiber layer. These deposited fibers 31 are essentially put in parallel position, i.e. they lie essentially parallel next to each other in the main sense of orientation 11. The thin fiber layer is collected at the collection line 13 and begins to rotate in the interaction of forces. At the collection line 13 all the fibers 31 needed for the formation of the yarn are accumulated in the above-described manner. The drawing off of the fibers 31 is continuous when the amount of fibers required for the yarn have accumulated. In a preferred embodiment this fiber accumulation 34 is again slightly drawn during draw-off so that the fibers 31 retain the desired, proper orientation or are able to assume it fully. A true cable is produced by the twisting element 4 as it imparts twist. Feeding speeds such as are possible in unconventional, rapid spinning processes, i.e. feeding speeds in the range above 300 m/min can be realized with this spinning process according to the instant invention.

By separating the functions of fiber collection, fiber incorporation and the imparting of twist to the yarn, as well as by avoiding the detrimental production of enveloping fibers as in conventional friction spinning processes, it is possible in an advantageous manner to produce a high-grade and high-quality yarn. The formation of enveloping fibers is avoided in the instant invention because the drive of the rotational movement of the fiber accumulation originates in the twisting element and not in the collection surface. As a result the fiber accumulation is twisted together to a greater extent than is customary in conventional friction spinning processes where the drive of the yarn originates in the combined collection and twisting surface.

The introduction of twist into the fiber accumulation 34 is effected by the sieve roller 1 in a direction opposite of that of the twisting element 4 following it. Furthermore less twist is introduced into the fiber accumulation 34 than in the twisting element 4. The difference between the two twists results in the final twist after yarn draw-off. The transition point of the two directions of twist is located in the area of the sieve roller 1. The opposite direction of the twisting device causes the fiber accumulation 34 to remain at the collection line 13 and does not wander from it in direction of the outlet of the fiber feeding channel. This would occur since the rotating motion of the fiber accumulation would be in opposition to the direction of twist of the collection roller upward. As a result of this the effect of good fiber orientation would again be lost. The same direction of rotation for the sieve roller 1 and the twisting element 4 can be used if the fiber accumulation is kept at the collection line 13 by flow technology methods.

Figure 2:
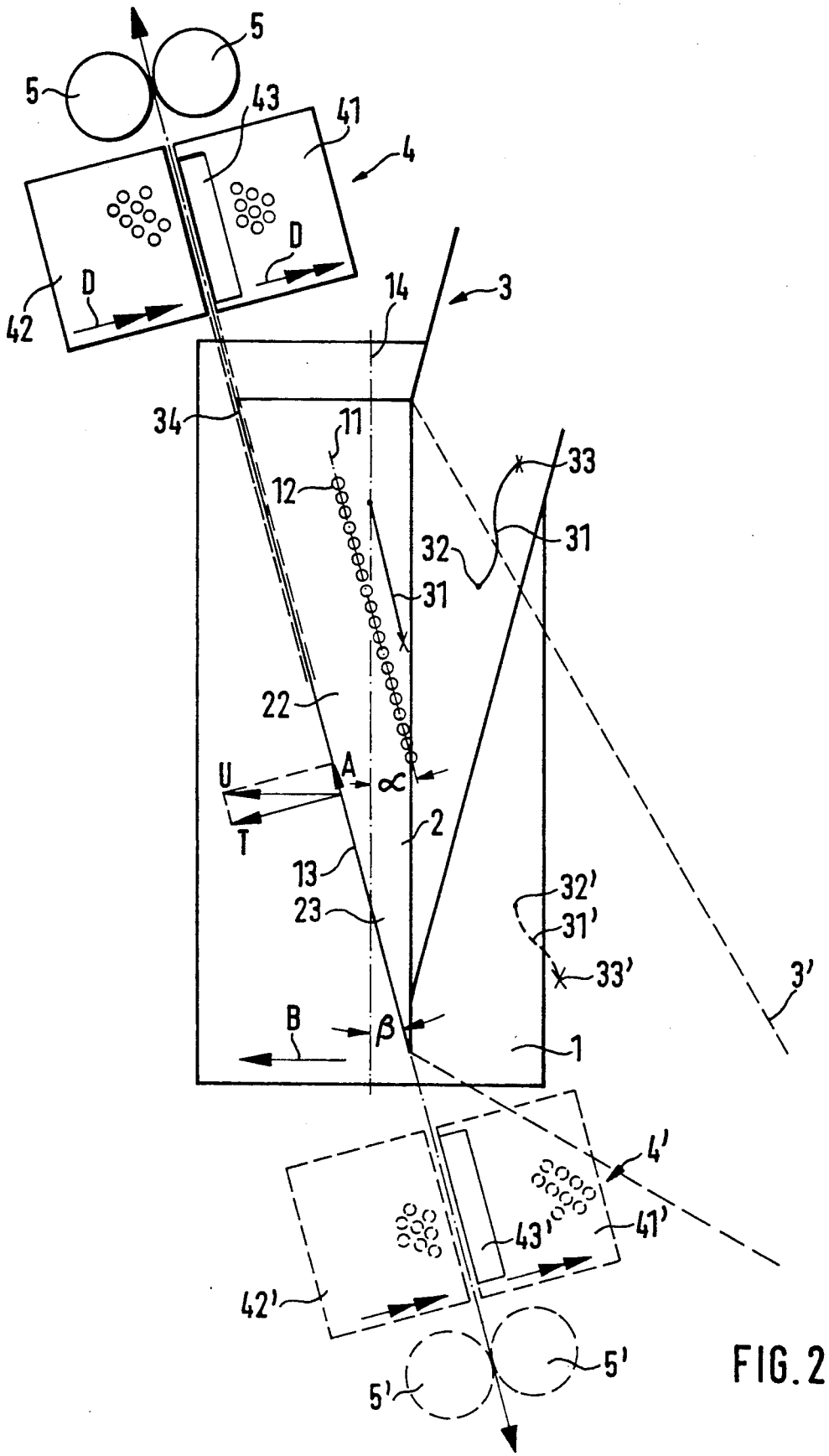

FIG. 2 shows a spinning device according to FIG. 2 which is designed in its essential parts in a similar manner as the device according to FIG. 1. The most significant difference from FIG. 1 is that the collection line 13 is not parallel to the axial line 14 of the sieve roller 1 but is inclined at an angle $\beta$ with respect to a axial line 14. As a result of the inclination at the angle $\beta$, a collection line 13 in form of a helical line appears on the circumference of the sieve roller 1.

The fibers 31 are supplied in the area of the suction insert 2 or suction slit 22 via fiber feeding channel 3 of the sieve roller 1 similarly to the embodiment of FIG. 1. The fibers 31 impact the fiber head 32 on the sieve roller 1 which moves in direction B, they fold over and come to lie on the sieve roller 1 in the main sense of orientation 11 of the suction holes 12. The suction slit 22 is in the form of a right triangle with the hypotenuse of the triangle forming an angle $\alpha$ with the collection line 13.

In the embodiment of FIG. 2 the angle $\alpha$ between the axial line 14 and the main sense of orientation 11 is equal to the angle $\beta$ between the axial line 14 and the suction edge 23 of the suction slit 22. This means that the fibers 31 are conveyed to the collection line 13 in a position parallel to the suction edge 23. The fibers are accordingly deposited parallel to each other at the collection line 13 and rotate essentially parallel to the axis of the fiber accumulation 34. This means that the fibers 31 roll against each other in the ideal case.

Additional forces act upon the fiber accumulation 34 as a result of the oblique placement of the suction edge 23 at the angle $\beta$ with the axial line 14. This becomes apparent from a representation of vectors. A vector U designates the peripheral force acting upon the fiber accumulation 34 through the rotating sieve roller 1. Through this peripheral force U as well as through the suction forces of the suction insert 2 and the centrifugal forces of the rotating sieve roller 1 acting upon the fibers or the fiber accumulation, a rotation component T is created which acts at a perpendicular upon the longitudinal axis of the fiber accumulation 34. The formation of the force parallelogram explains that now a force component A, contrary to the device of FIG. 1, acts in the longitudinal direction of the fiber accumulation 34. This force component A causes either a thrust component or a traction component to be exerted on the fiber accumulation 34 depending on the draw-off direction of said fiber accumulation. If the fiber accumulation 34 is drawn off by means of the draw-off rollers 5 via twisting element 4 with the friction rollers 41 and 42, the force component A causes the fibers 5 to push in the direction of yarn draw-off. Spinning tension is thereby reduced somewhat. The fibers are slightly pushed on from their accumulation position. If draw-off is effected by means of the draw-off rollers 5' via friction rollers 41' and 42' of the twisting element 4', the force component A acts as a traction force contrary to the direction of draw-off. The spinning tension is thus somewhat increased. The fiber accumulation 34 undergoes stretching by the traction force. The twisting element 4 or 4' as well as the draw-off rollers 5 or 5' are placed in the embodiment of FIG. 2 in a straight-line prolongation of the collection line 13. This ensures that the fiber accumulation 34 is fed to the twisting element 4 or 4' without alteration of the position of the individual fibers 31.

Figure 3:
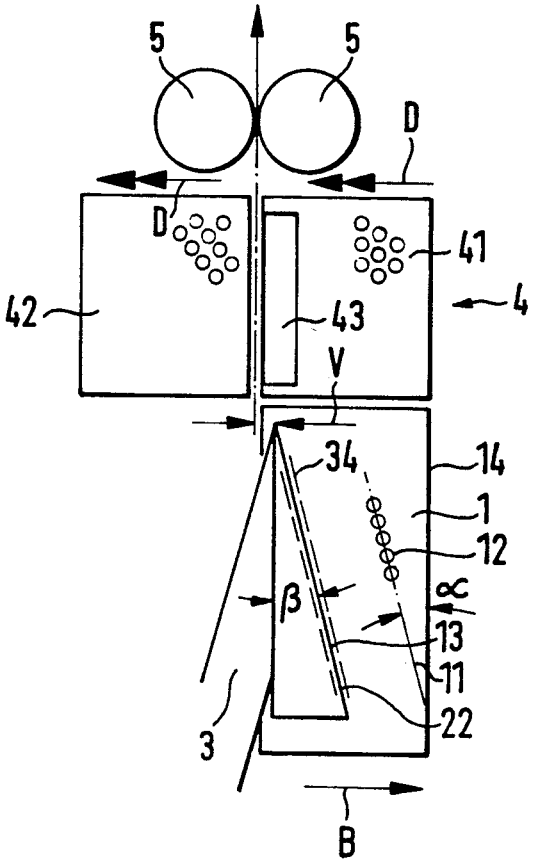

Instead of the installation of the fiber feeding channel 3, an installation with fiber feeding channel 3' is also possible. While the fibers fold over as they land on the sieve roller 1 due to the placement of the fiber feeding channel 3 together with the position of the main sense of orientation 11 of the suction holes 12, this is avoided with an installation of a fiber feeding channel 3'. The fiber feeding channel 3' is designed so that the fly direction of the fibers is oriented essentially in direction of the main sense of orientation 11 of the suction holes 12. Thus the fibers do not fold over but land in a kind of floating mass on the suction holes 12. Although the stretching of the fibers is not as marked with this type of feeding than when a fiber fold-over takes place, the influence of the fibers upon each other is less and this is advantageous especially in the production of rough yarns where a great number fibers is necessary. The inclination of the fiber feeding channel 3' is approximately equal to the angle $\alpha$ of the main sense of orientation 11 of the suction holes 12. Upon landing the fibers 31' are held fast by fiber head 32' by the suction force of the sieve roller 1 and the fiber end 33' is laid by the direction of movement B of the sieve roller 1 on sad sieve roller 1 in the main sense of orientation 11. FIG. 3 shows an advantageous design of an embodiment similar to that of FIG. 2. The fibers are fed on the sieve roller 1 in the area of the suction slit 22 along the fiber feeding channel 3. Due to the arrangement of the suction holes 12 in main sense of orientation 11 with respect to the direction of fiber feeding the fibers fold over and come to lie against the suction holes 12 in the main sense of orientation 11. The fibers 31 are fed to the surface of the sieve roller 1 at a tangent so that an orderly deposit of fibers is ensured advantageously. In this embodiment too the angle $\alpha$ between circumferential line 14 and main sense of orientation 11 as well as angle $\beta$ between circumferential line 14 and collection line 13 are equal so that a parallel fiber accumulation 34 is produced at the collection line 13.

Concerning the placement of the twisting element 4 with respect to the sieve roller 1 it should be pointed out in the embodiment of FIG. 3 that the friction roller 41 subjected to suction has the same diameter as well as the same axis. This simplifies the mounting of the sieve roller 1 and of the twisting element 4.

Furthermore advantages result in the constructive design of the suction of friction roller 41 and sieve roller 1.

For the fiber accumulation 34 this placement of the twisting element 4 in relation to the sieve roller 1 or the collection line 13 means that it is reversed on its way from the collection line 13 via the nip of the twisting element 4 to the draw-off rollers 5. The end of the suction slit 22 towards the twisting element 4 is provided with a lateral offset V in relation to the suction insert 43 of the friction roller 41, causing the fiber accumulation to lie against the collection line 13 to the end of the suction slit 22. The fiber accumulation 34 is thus enabled to cover the path between sieve roller 1 and friction roller 41, said path not being subjected to suction. This results in advantages in the maintenance of the orientation of the fiber accumulation 34. Only after the suctionless path between the sieve roller 1 and the friction roller 41 has been covered is the fiber accumulation 34 reversed in direction of the nip of the twisting element 41 and is drawn off in a straight line by the draw-off rollers 5. The reversal of the fiber accumulation takes place essentially in the area of the suction insert 43.

The fiber accumulation 34 fed to the twisting element 4 is slaved by the friction roller 41 rotating counter to the direction of movement B of the sieve roller 1 into the nip between the two friction rollers 41 and 42 in the area of the suction insert 43. The suction slit edge of the suction insert 43 in the nip between the two friction rollers 41 and 42 causes an incorporation of the fibers 31 until final imparting of twist to the forming yarn. The rotational speed of the friction rollers 41 and 42 is a multiple of the rotational speed of the sieve roller 1 just as in the preceding embodiments.

In a manner similar to that described in FIG. 2, a force component is produced in the fiber accumulation in its axial direction. This is due to the fact that the draw-off direction of the fiber accumulation is not perpendicular to the direction of movement B of the collection surface. In the arrangement of FIG. 3 a traction force component acting counter to the draw-off force is produced in the fiber accumulation 34.

Figure 4:
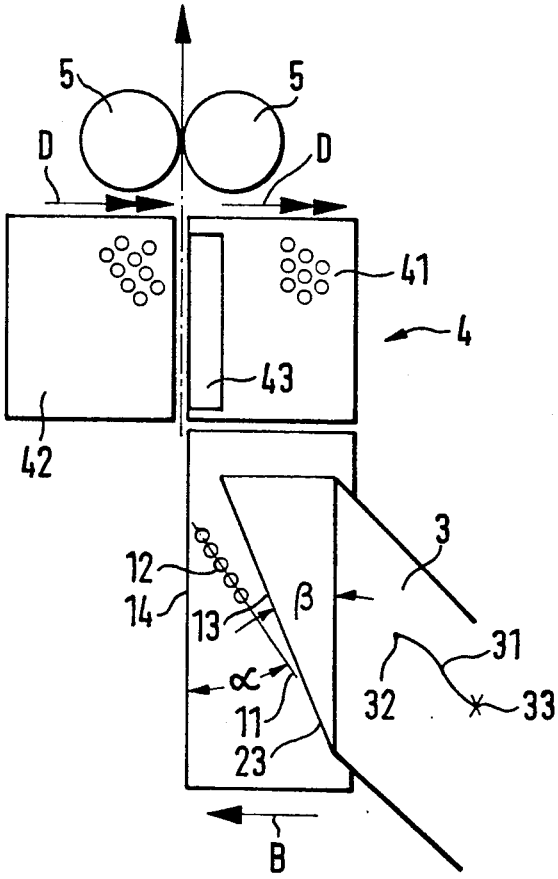

FIG. 4 shows an embodiment in which the directions of rotation of the sieve roller 1 as well as that of the friction rollers 41 and 42 are opposite to those of FIG. 3. The fibers are accordingly fed through the fiber feeding channel 3 which is installed on the side away from the friction roller 42 not subjected to suction. As a result of this placement of the fiber feeding channel 3 no folding over of fibers but a fiber deposit takes place as the fibers 31 land on the sieve roller 1. The fibers 31 land with fiber head 32 first in the area of a suction hole 12 subjected to suction and then come to lie essentially in the main sense of orientation 11 against the suction holes 12. In the embodiment of FIG. 4 the angle $\alpha$ between the axial line and the direction of fiber deposit, i.e. the main sense of orientation 11, is wider than the angle $\beta$ between suction edge 23 and circumferential line 14. Similarly as in the embodiment of FIG. 1, this causes an incorporation of the fibers 31 in form of a helical line into the fiber accumulation 34 at the collection line 13. The fibers 31 are first incorporated with the fiber head 32 into the fiber accumulation 34. Twisting of the fibers 31 in the fiber accumulation 34 produces greater strength already in the fiber sliver of the fiber accumulation 34 than in cases where the fibers 31 are parallel to each other as they lie in the fiber accumulation 34. Furthermore the fibers 31 can be stretched by a yarn draw-off speed that is higher than the fiber feeding speed as they are incorporated, and this has an advantageous effect on yarn strength.

In contrast to FIG. 1, a force component is produced in the embodiment of FIG. 4 in addition to the fiber incorporation which produces a thrust in the fiber accumulation 34 in this embodiment.

The lateral offset of the suction inserts 2 and 43 must be selected in the same manner as explained in the description of FIG. 3. Instead of the sieve roller 1 a sieve band conveying the fibers in the direction of movement B from the fiber arrival zone to the collection line can also be used in all the embodiments.

Figure 5:
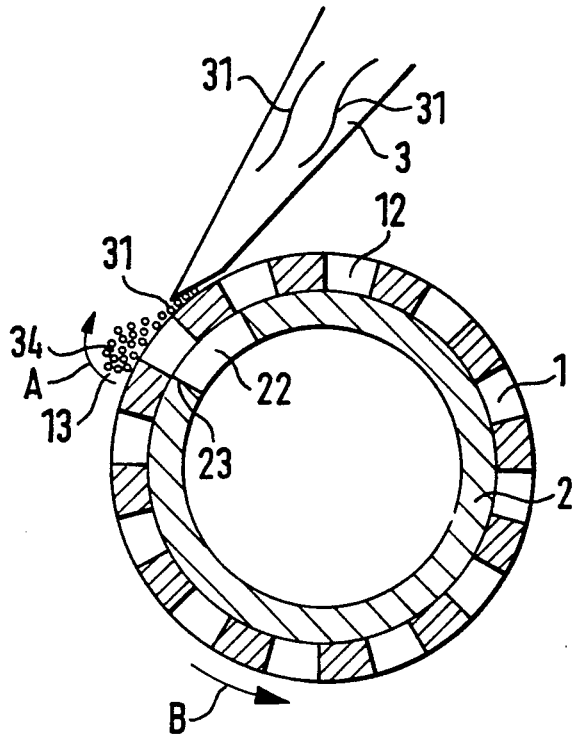
FIG. 5 shows a cut-away drawing through a collection roller

FIG. 5 shows a cross-section through the sieve roller 1 in the area of fiber-31 feeding and collection. The fibers 31 are fed here essentially at a tangent through the fiber feeding channel 3 to the surface of the sieve roller 1. The fibers 31 land on the sieve roller 1 in the area of the suction slit 22 of the suction insert 2. This causes the fibers 31 to be held on the surface of the sieve roller 1 and to be moved by the rotation of the sieve roller 1 in the direction of movement B to the suction edge 23. After the suction edge 23 no suction force acts upon the fibers 31 so that they leave the surface of the sieve roller 1 as a result of centrifugal force. The fibers then roll off at the collection line 13 in the fiber accumulation 34 in direction of rotation A. The fiber accumulation 34 rotates in the direction of rotation A due to the interplay of forces between the suction force acting through the suction holes 12 upon the surface of the sieve roller 1 and the centrifugal force which causes a loosening of the fibers 31 in the zone of the sieve roller 1 which is not subjected to suction. The direction of rotation A of the fiber accumulation 34 is opposite to the direction of movement B of the sieve roller 1.

Figure 6:
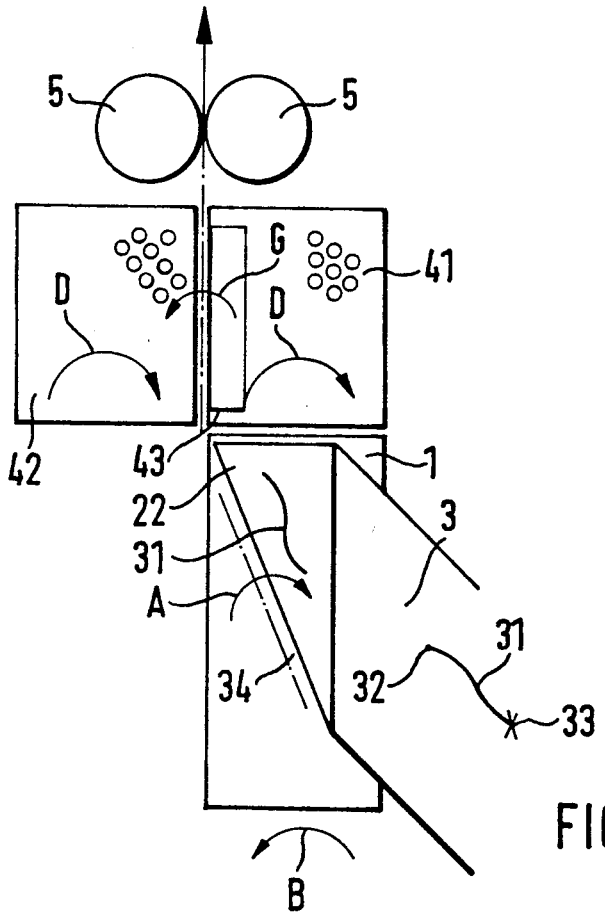
FIG. 6 shows a representation of twist

In FIG. 6 the rotational movements of the individual rollers and of the fiber accumulation 34 and of the yarn 35 are shown to clarify the conditions of rotation. The fibers 31 fed through the fiber feeding channel 3 are conveyed in direction of movement B of the sieve roller 1 to the collection line 13. There they are incorporated into the fiber accumulation 34 and pre-twisted in direction of rotation A counter to the direction of movement B.

The friction rollers 41 and 42 rotate in the direction of rotation D at considerably higher speed than the rotational speed of the sieve roller 1. The fiber accumulation 34 is held in the nip between the two friction rollers 41 and 42 by the friction of the friction rollers 41 and 42 as well as by the suction force provided by the suction insert 43. The fiber accumulation 34 is rotated in the nip of the friction rollers 41 and 42 in a direction of rotation G counter to the direction of rotation A on the sieve roller 1. This reversal of rotation causes the fibers 31 in the fiber accumulation 34 to be stretched once more and to be oriented, and the yarn then produced receives its final and desired twist. The thus twisted yarn is drawn off by the draw-off rollers 5. The reversal of the direction of rotation A into direction of rotation G generally occurs in the area of the sieve roller 1 as the rotation of the friction rollers 41 and 42 is superimposed on the rotation of the sieve roller 1.

The difference between the directions of rotation A and G is necessary in the embodiment shown in order to fix the end of the fiber accumulation 34 at the collection line 13. A reversal of the direction of rotation is not necessary if a movement of the end of the fiber accumulation 34 in direction of the outlet of the fiber feeding channel is prevented by measures such as an air curtain for example.

Figure 7:
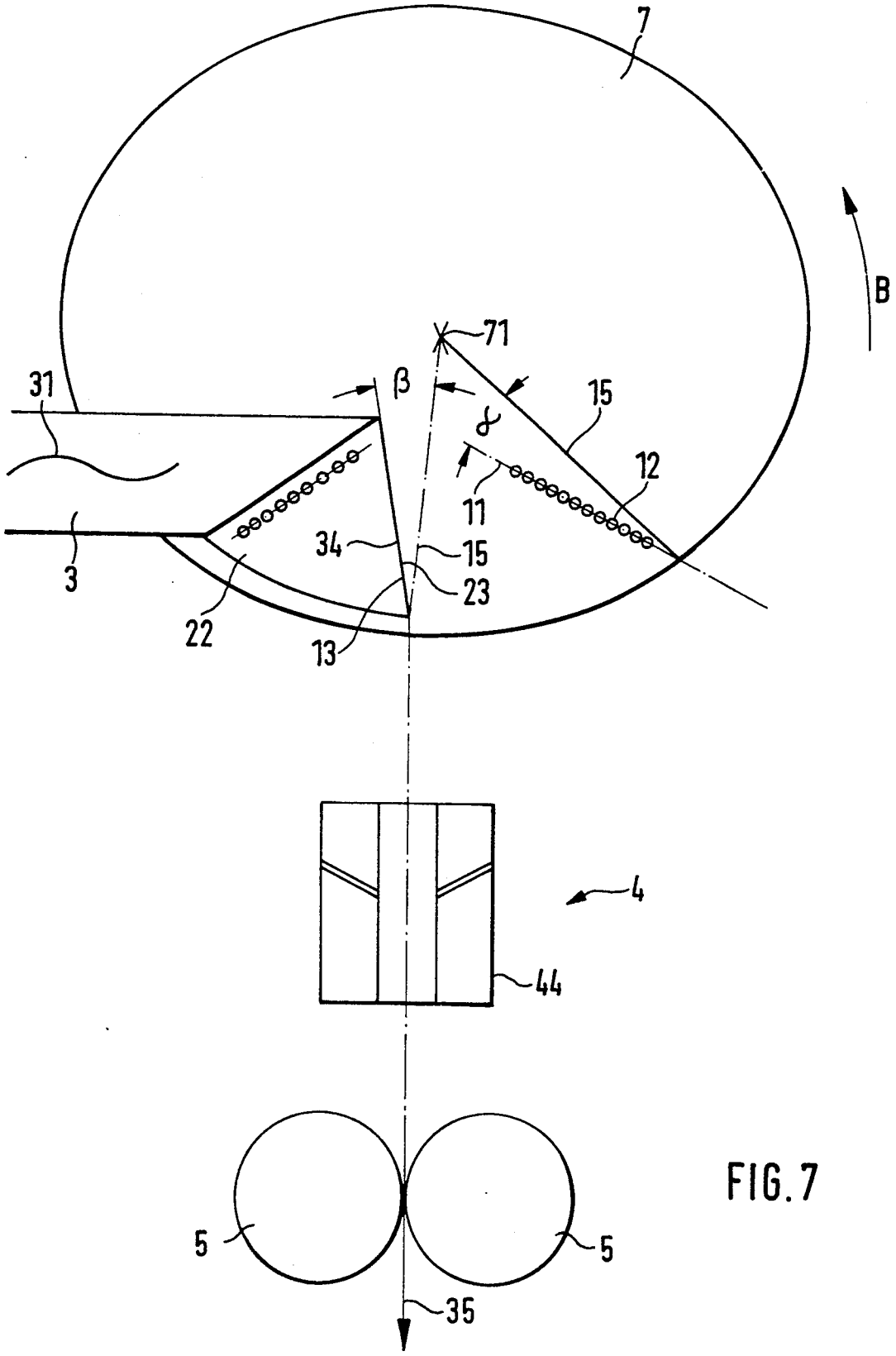
FIG. 7 shows a perforated disk as the collection surface with a downstream air nozzle.

FIG. 7 shows an embodiment according to the instant invention in which a sieve disk 7 is used as the collection surface and an air spinning nozzle as the twisting element 4 are provided. Fibers 31 are conveyed through fiber feeding channel 3 to the zone of sieve surface 7 which is subjected to suction. As in the embodiment with the sieve roller, the fibers 31 come to lie on the sieve disk 7 in the main sense of orientation 11 of the suction holes 12. In this position they are conveyed to the collection line 13 which is constituted by the suction edge 23 of the suction slit 22. The position of the main sense of orientation 11 is at an incline forming an angle $\alpha$ with the radius 15 of the sieve disk 7. As a result a traction or thrust force component is produced in the fiber accumulation 34, depending on the direction of draw-off or on whether the angle $\alpha$ is oriented in the direction of movement B or in the opposite direction. The angle $\alpha$ is of the same size and direction as the angle $\beta$ between the suction edge 23 and the radius 15. The fibers 31 are thereby conveyed essentially at a parallel to the collection line 13. If the traction or thrust force component is to be avoided as in the embodiment of FIG. 1, the angles $\alpha$ and $\beta$ must be selected so as to equal 0°, i.e. the suction edge 23 as well as the main sense of orientation 11 correspond to the position of radius 15.

The fiber accumulation 34 is pre-twisted on the sieve disk 7 at the collection line 13 in a manner similar to the embodiments described earlier. This pre-twisted fiber accumulation 34 is conveyed to a twisting element 4 located downstream of the fiber accumulation 34 in the direction of draw-off. The twisting element 4 of the embodiment of FIG. 7 consists of air nozzle 44. In this twisting element 4 the fiber accumulation 34 is imparted the final and predetermined twist of yarn 35. The yarn 35 produced is drawn off by means of the draw-off rollers.

In the device according to FIG. 7 it is advantageous that fast running drawing rollers as are required normally in air spinning devices are avoided.

Figure 8:
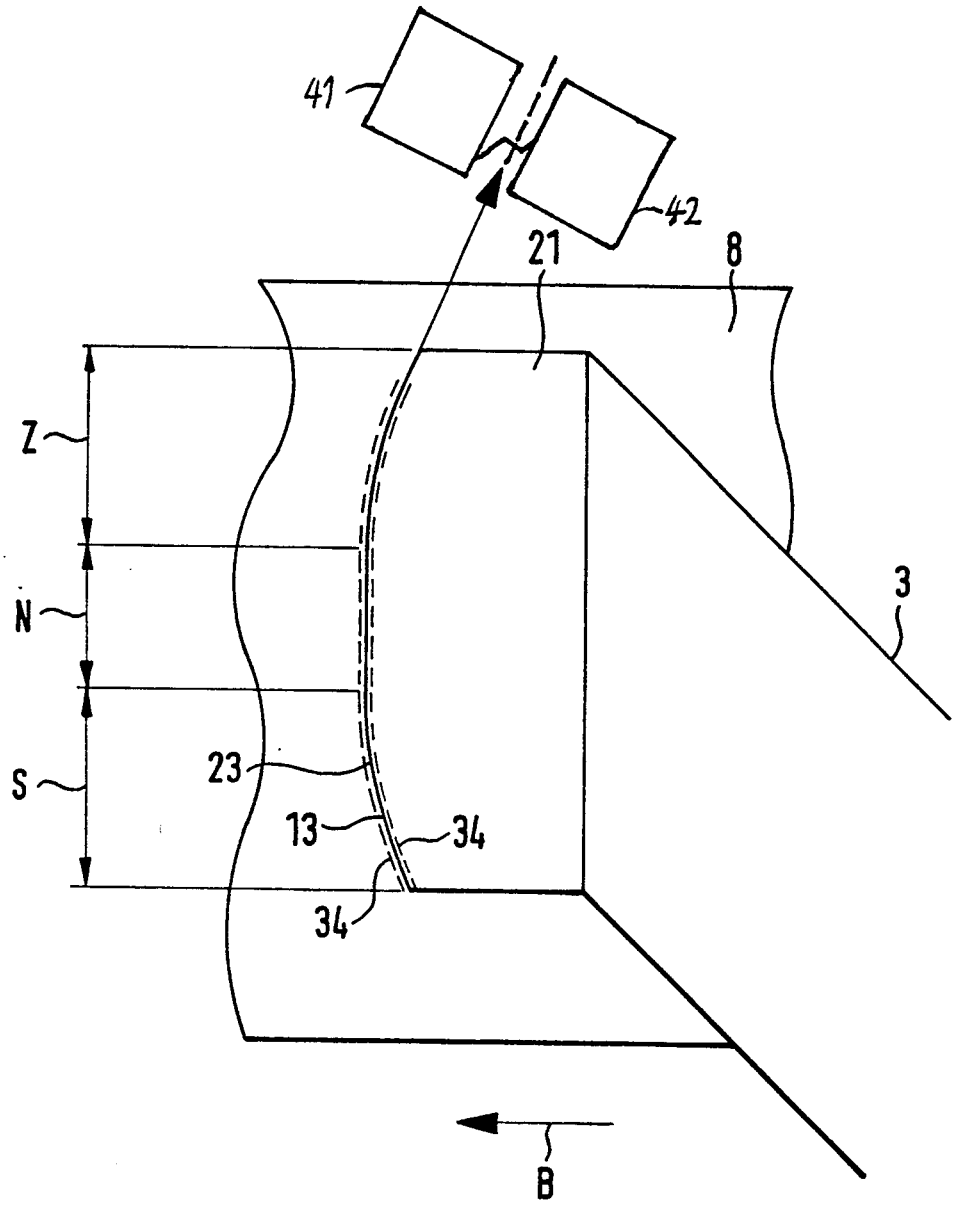
FIG. 8 shows a perforated band as the collection surface.

FIG. 8 shows a device according to the instant invention in which the collection surface is made in form of a sieve band 8. The fibers are again conveyed via fiber feeding channel 3 and sieve band 8 within range of suction. The fibers are moved to the collection line 13, roll into a fiber accumulation 34 at that location and are drawn off from the sieve band 8. The suction slit 21 of suction insert 2 which subjects the fiber feeding zone up to the collection line 13 with suction is designed so that different zones are produced at the collection line 13. In a zone S a thrust force is exerted upon the end of the fiber accumulation. This causes individual fibers which do not yet have much cohesion at the end of the fiber accumulation 34 to be pushed together. Following this thrust zone in draw-off direction, a neutral zone N is provided. The fiber accumulation 34 is pre-twisted in this zone without thrust or traction forces. At the same time good orientation of the fibers is ensured. A traction zone Z follows, throughout which a traction force acts upon the fiber accumulation 34 and thus increases the spinning tension. A twisting element follows the sieve band 8 as in the preceding embodiments. The suction edge 23 is not limited to the configuration shown. Suction edges with thrust and zero-force zones or with traction and zero-force zones are also possible.

Figure 9:
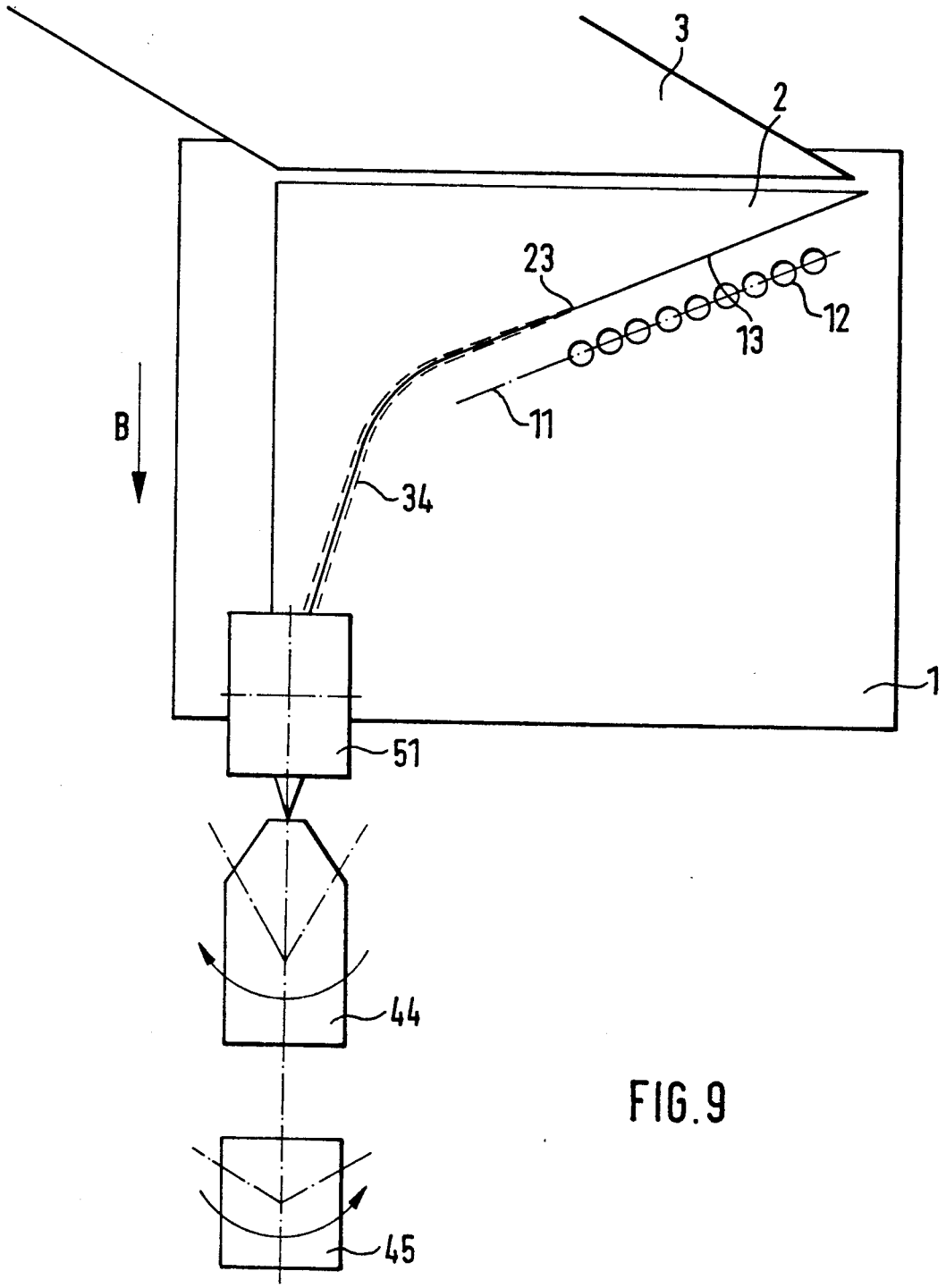
FIG. 9 shows a sieve drum with the direction of draw-off of the fiber accumulation in the direction of rotation of the sieve drum and FIGS. 10 and 11 show a diagram of holes in the collection surfaces.

FIG. 9 shows a variant of the invention in which an alteration of the thrusting force component is produced in the fiber accumulation 34 at the suction edge 23 of the suction insert 2 due to the latter's configuration. As in the embodiments described earlier, the fibers are fed on the sieve roller 1 through the fiber feeding channel 3 and are accumulated and pre-twisted at the suction edge 23 or collection line 13. The suction edge 23 is domed in the direction of movement B of the sieve roller 1. The fiber accumulation 34 moves along the suction edge 23 in the direction of the draw-off point of the fiber accumulation 34 which is determined by a pressure roller 51. The fiber accumulation 34 gradually reaches the peripheral speed of the sieve roller 1 as it moves along the suction edge 23. the pressure roller 51 clamps the fiber accumulation at a clamping point between pressure roller 51 and sieve roller 1. Upon leaving the clamping point the fiber accumulation thus formed can be fed to a conventional air spinning device with injection nozzle 44 and twisting nozzle 45. In this air spinning device the desired yarn is then produced and given the appropriate yarn quality.

In addition to the embodiments shown in the figures, analogous means to carry out the process under the instant invention are of course also protected. Thus a non-cylindrical sieve roller instead the sieve roller 1, the sieve disk 7 or the sieve band 8 can also be used to constitute the fiber accumulation. The suction insert 2 is not limited to the configuration shown. Just as the configurations shown, any other configurations of the suction insert 2 also come under the protection of the invention leading to an fiber accumulation according to the invention through the process described. Thus slit edges can for instance be used, exerting thrust at the end of the fiber accumulation 34 and exerting traction upon the fiber accumulation in the area of the point at which the fiber accumulation 34 is transferred to the twisting element 4.

Instead of the twisting elements 4 shown, any other twist-imparting devices can be used. Thus the utilization of conical friction rollers in particular to form a yarn lies within the scope of the instant invention. Similarly, twisting tubes may be used as twisting elements. The requirements of the device according to FIG. 2 as far as length and width of the suction inserts 2, 43 or 43' are concerned apply in the same way to the devices according to FIGS. 1 to 4. The same also applies to the speeds of the sieve roller 1 in relation to the friction rollers 41 and 42 or 41' and 42'.

Figure 10:
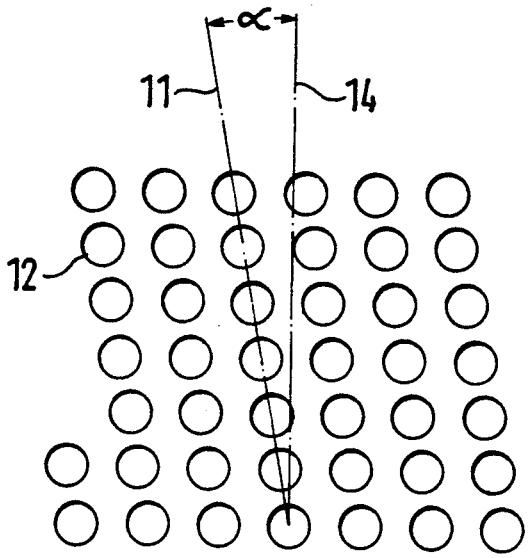
Figure 11:
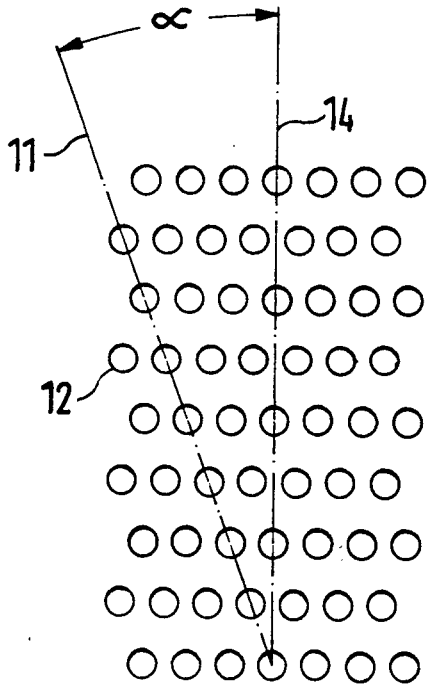

FIGS. 10 and 11 show typical hole diagrams as used on the collection surface. In FIG. 10 the distance between the suction holes 12 is smallest in the main sense of orientation 11. The distance to all the other suction holes 12 not on the main sense of orientation 11 is greater. Furthermore the angle $\alpha$ between circumferential line 14 and main sense of orientation 11 can be recognized in this hole diagram.

In FIG. 11 the arrangement of the suction holes 12 shows a main sense of orientation 11 where the lateral distance between the suction holes 12 is smaller than the distance in the main sense of orientation 11. Such a hole diagram can be used on the collection surface if it is ensured that the fibers arrive only in the approximately sense of the main sense of orientation 11 and can be deposited thanks to the direction of fiber feeding and direction of movement of the collection surface.

An angle of less than 45° between the main sense of orientation 11 and the suction edge 23 has proven to be advantageous. Especially good results in fiber orientation in the fiber accumulation 34 are achieved with an angle of less than 20° between the fiber axis or main sense of orientation 11 and the suction edge 23.

The collection line 13 or suction edge 23 forms an angle of 20° with the axial line 14 or radius 15, i.e. the perpendicular to the direction of movement.

The instant invention not only relates to the embodiments shown but also to any combination of the components shown with each other as well as to devices with elements analogous to the shown fiber feeding devices, yarn draw-off devices and directions of rotation and movement. By covering the suction slit on the collection surface by a counter-contour which does not come into contact with the fiber accumulation, a reduction in air consumption can be achieved.

We claim:

1. An apparatus for spinning yarn from fibers, comprising:

a perforated fiber collection surface for collecting fibers, said collection surface having a pre-determined pattern of perforations defined therein arranged along a main sense of orientation, said fiber collection surface adapted for being rotated at a pre-determined rotational speed;

a suction insert disposed generally under said collection surface and adapted to draw air through said perforations moving across a defined suction zone, whereby fibers are drawn to said collection surface and held against said collection surface along said main sense of orientation as said fiber collection surface rotates through said suction zone;

a suction edge forming a collection line for said fibers at a pre-determined angle relative to a perpendicular line to the direction of movement of said collection surface, said suction edge defining the furthest boundary of said suction zone relative the rotational direction of said fiber collection surface whereby as said fibers are carried past said suction edge they leave said collection surface due to centrifugal forces and are drawn back into said suction zone by said suction insert, said fibers thereby gathering along said suction edge forming a fiber accumulation along said collection line, said fiber accumulation thereby having a pre-twist imparted thereto from the interaction of said centrifugal forces and said suction forces, said main sense of orientation of said perforations forming a predetermined non-zero angle with said collection line; and a twisting element comprising a pair of friction rollers, said fiber accumulation being drawn through said twisting element by yarn draw-off means, said twisting element disposed in-line relative the direction of yarn draw-off between said collection line and said yarn draw-off means, said twisting element configured to impart a final twist to said fiber accumulation thereby forming yarn having a predetermined degree of twist from said fiber accumulation.

2. The apparatus as in claim 1, wherein said perforations are disposed within said collection surface so that the space between said perforations lying along said main sense of orientation is less than the space between adjacent perforations not lying along the main sense of orientation.

3. The apparatus as in claim 1, further comprising a feeding channel disposed adjacent said suction zone whereby said fibers are drawn through said feeding channel towards said suction zone.

4. The apparatus as in claim 1, wherein said collection line forms a non-zero angle with a line perpendicular to the direction of movement of said collection surface.

5. The apparatus as in claim 1 wherein said collection line forms an angle with a line perpendicular to the direction of movement of said collection surface of substantially 0 degrees.

6. The apparatus as in claim 1, wherein said main sense of orientation of said perforations forms an angle with said collection line of less than 45 degrees.

7. The apparatus as in claim 1, wherein said fiber collection surface comprises a sieve roller configured to spin about its longitudinal axis.

8. The apparatus as in claim 1, wherein said fiber collection surface comprises a sieve band.

9. The apparatus as in claim 1, wherein said suction insert comprises a suction slit being rectangular in shape.

10. The apparatus as in claim 1, wherein said friction rollers are driven in a direction of rotation opposite that of said fiber collection surface.

11. The apparatus as in claim 1, wherein said friction rollers are driven at a rotation speed greater than that of said fiber collection surface.

12. A spinning process for producing yarn, said process comprising the steps of:

defining suction holes in a spinning perforated collection surface along a predetermined main sense of orientation;

drawing air through the suction holes in a suction zone of the collection surface;

defining a collection line on the collection surface at a predetermined angle relative to a line perpendicular to the direction of movement of the spinning collection surface, the collection line being an edge of the suction zone, the main sense of orientation of the suction holes forming a predetermined non-zero angle with the collection line;

introducing yarn fibers onto the spinning perforated collection surface at the suction zone so that the yarn fibers are orientated on the collection surface along the main sense of orientation of the suction holes;

conveying the yarn fibers through the suction zone orientated along the main sense of orientation of the suction holes to the collection line;

forming the yarn fibers into fiber accumulation along the collection line;

pre-twisting the fiber accumulation at the collection line; and final twisting the fiber accumulation into a yarn with a pair of friction rollers disposed in-line relative the collection line in the direction of yarn draw-off, said final twisting being at a greater speed than said pre-twisting.

13. The process as in claim 12, wherein said step of defining suction holes in a spinning perforated collection surface along a predetermined main sense of orientation comprises spacing the suction holes so that the distance between adjacent suction holes along the main sense of orientation is least compared to adjacent suction holes not along the main sense of orientation.

14. The process as in claim 12, wherein said step of defining a collection line on the collection surface at a predetermined angle comprises defining the predetermined angle at a non-zero angle.

15. The process as in claim 12, including orienting the fibers along the main sense of orientation of the suction holes in the collection surface at an angle less than 45 degrees from the collection line.

16. The process as in claim 12, including orienting the fibers along the main sense of orientation of the suction holes in the collection surface at an angle of approximately 20 degrees from the collection line.

17. The process as in claim 12, wherein said pre-twisting comprises twisting the fiber accumulation at the collection line in a direction opposite to the direction of twist imparted during said twisting by the twisting element.

* * * * *